US005758447A

United States Patent [19]

Venetz

[11] Patent Number: 5,758,447

[45] Date of Patent: Jun. 2, 1998

[54] RECOIL ABSORBING DEVICE AND METHOD

[76] Inventor: Louis M. Venetz, 19 North St., West Pittston, Pa. 18643

[21] Appl. No.: 831,121

[22] Filed: Apr. 1, 1997

[51] Int. Cl.[6] ..... F41C 27/00

[52] U.S. Cl. ..... 42/94; 42/97

[58] Field of Search ..... 42/94, 97; 89/37.04

[56] References Cited

U.S. PATENT DOCUMENTS

| | | | |
|---|---|---|---|
| 3,772,813 | 11/1973 | Sands | 42/94 |
| 3,935,657 | 2/1976 | Wade | 42/94 |
| 4,876,814 | 10/1989 | Lombardo | 42/94 |
| 5,081,783 | 1/1992 | Jarvis | 42/94 |
| 5,233,779 | 8/1993 | Shaw | 42/94 |
| 5,332,185 | 7/1994 | Walker, II | 248/346 |

*Primary Examiner*—Charles T. Jordan
*Assistant Examiner*—Meena Chelliah
*Attorney, Agent, or Firm*—Michael J. Delaney

[57] ABSTRACT

An improvement in a device for absorbing the recoil of a rifle fired while extending above a horizontal surface with the barrel of the rifle supported by a rest member. The improvement is a weighted bag member resting freely on and unattached to the horizontal surface. The weighted bag member includes a first strap which extends along the stock and around the butt of the rifle, and a second strap which is attached to the first strap and extends over the stock of the rifle.

4 Claims, 2 Drawing Sheets

RECOIL ABSORBING DEVICE AND METHOD

FIELD OF THE INVENTION

This invention relates generally to a device which absorbs recoil from a fired rifle and more specifically to such a device including a weighted bag member which rests freely on a surface below the rifle and by means of taut straps in contact with the butt and stock of the rifle.

BACKGROUND OF THE INVENTION

It is known in the prior art to provide recoil absorbing devices for a firearm. However the prior art devices are not entirely satisfactory. Some of the devices are extremely complex. Others devices are not readily portable. Still other devices restrain the firearm to such an extent that the firearm may tend to rotate and/or move upwardly upon firing. Prior art devices are disclosed in U.S. Pat. No. 4,799,324 to Nodo; U.S. Pat. No. 4,821,443 to Bianco; U.S. Pat. No. 4,841,839 to Stuart; and U.S. Pat. No. 5,419,233 to Mulvaney.

SUMMARY OF THE INVENTION

It is an object of this invention to provide a simple and inexpensive improvement in a recoil absorbing device for use with a rifle.

It is another object of this invention to provide a recoil absorbing device which is readily transportable and easily assembled and used.

It is a further object of this invention to provide an improvement in a recoil absorbing device for a rifle which provides excellent recoil absorption without affecting the normal movements of a fired rifle.

These objects can be obtained by providing an improvement in a rifle recoil absorbing device comprising a substantially horizontal support surface, a rest member extending upwardly from the support surface to support the barrel of the rifle, and a weighted bag member resting freely on the horizontal support surface below the rifle. The bag is not physically attached to the support surface but merely rests freely thereon. A first strap of the weighted bag member extends tightly around and in contact with the butt of the rifle. The two ends of the first strap are connected to the sides of the weighted bag member. A second strap extends over the top of the stock of the rifle and has its ends attached to the first strap and acts similar to a suspender to hold the first strap in place about the stock and butt of the rifle.

DESCRIPTION OF THE PREFERRED EMBODIMENTS

Figure 2:
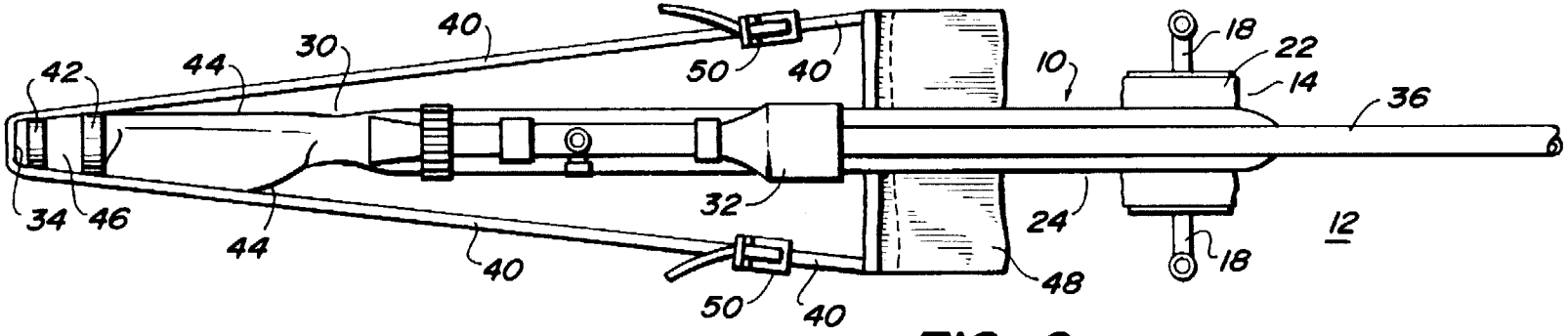
FIG. 2 is a top view of the apparatus of this invention.
Figure 3:
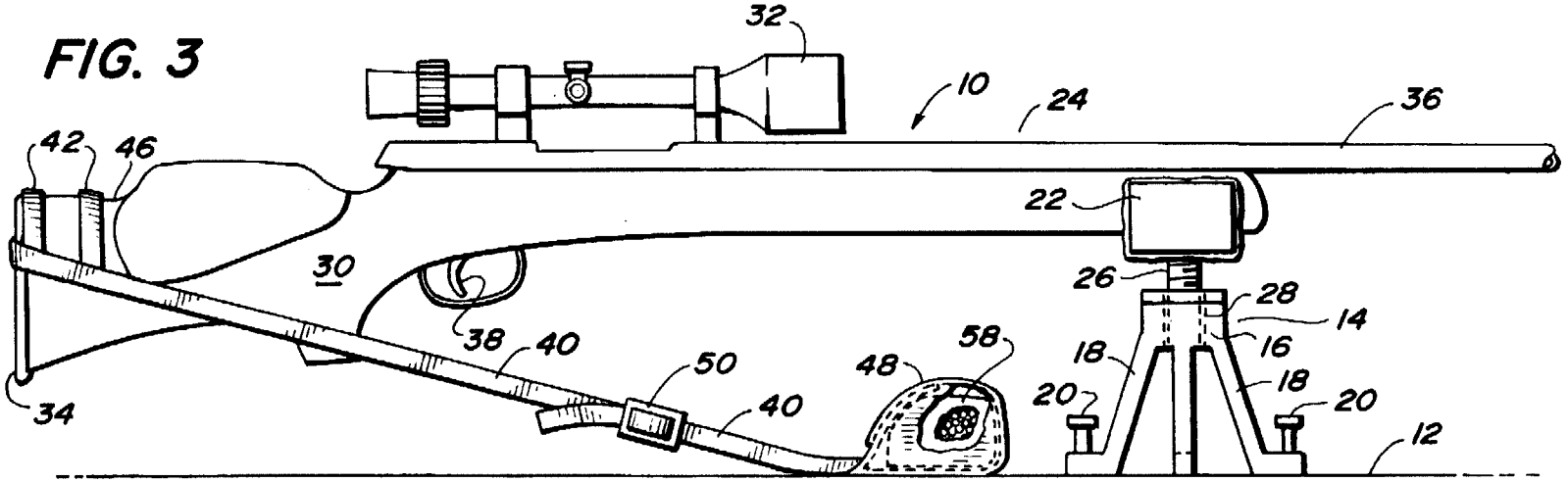
FIG. 3 is a side view of the apparatus of this invention.

Referring to FIGS. 2 and 3, a rifle 10 extends above a substantially horizontal surface 12. A rest member 14 extends upwardly from the horizontal surface 12. The rest member 14 has a base 16 with legs 18 which are attached to the horizontal surface 12 by means of bolts 20. Rest member 14 has a U-shaped member 22 in which the barrel end 24 of the rifle rests. The lower portion of the U-shaped member 22 has threads 26 which are in threaded engagement with internal threads 28 in the base 16. Thus, the U-shaped member 22 upon which the rifle 10 rests can be raised and lowered by means of threads 26 and 28 through rotation of U-shaped member 22.

Referring to FIGS. 2 and 3, rifle 10 has the usual barrel 36, stock 30, scope 32, butt 34 and trigger 38. Extending around the butt 34 of the rifle 10 and along both sides 44 of the stock 30 is a first strap 40. As best seen in FIG. 3, a pair of second straps 42 have their ends connected to the first strap 40 and extend upwardly along both sides 44 of the stock 30 adjacent the butt 34 of the rifle 10 and over the top 46 of the stock 30. Thus the first strap 40 and second strap 42 form a sort of cage which fits around the butt 34 and top 46 of the stock 30. As best shown in FIG. 2, first strap 40 is connected to the sides of the body of the weighted bag member 48. Positioned in the first strap 40 are two adjusting means 50, well known in the art, which allow the length of the first strap 40 on both sides of the rifle 10 to be adjusted, i.e. lengthened or shortened, and the first strap made taut when the recoil absorbing device is in use.

Figure 1:
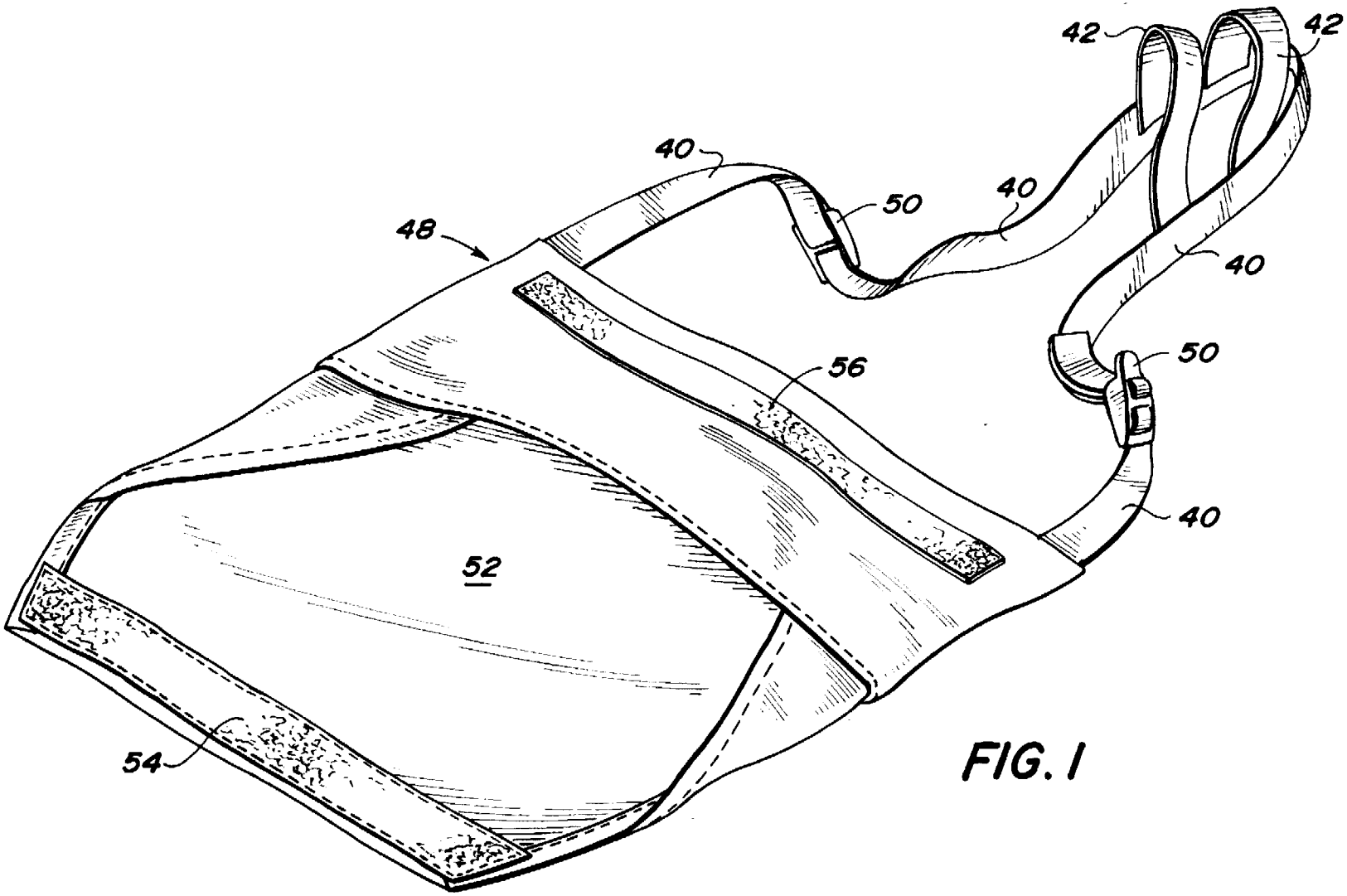
FIG. 1 is a three dimensional view of the weighted bag member.

Referring to FIG. 1, the weighted bag member 48 includes a flap 52 which has a Velcro loop surface 54 extending along its outer edge. The flap 52 can be folded and the Velcro loop surface 54 placed in contact with the Velcro hook surface 56 of the Velcro fastener which extends along the inner edge of the weighted bag member 48. By so doing a receptacle is formed within the weighted bag member 48 for receiving a weight. It has been found that a weight of about at least 25 pounds when placed within the weighted bag member 48 allows the recoil absorbing device to perform satisfactorily with all calibers of rifle from 30/30 to 458 Winchester Magnum.

The weighted bag member 48 including its first strap 40 and second strap 42 may be made from nylon material. As shown in FIG. 3, a bag 58 including a weight, such as metal shot, is placed in the weighted bag member 48.

When in use, the barrel end 24 of the rifle 10 is placed within the U-shaped member 22 of the rest member 14. Rest member 14 is adjusted to the proper height by means of threads 26 and 28 through rotation of U-shaped member 22. The weighted bag member 48, including bag 58 of metal shot, is placed below the rifle 10 and rests freely on the horizontal surface 12. The first strap 40 is placed around the butt of the rifle 10 and the second strap 42 is placed over the top 46 of the stock 30 adjacent the butt 34 of rifle 10. The length of first strap 40 is adjusted by the adjusting means 50 so that the first strap 40 is taut. The rifle 10 is now ready for firing in the usual manner. Once fired most of the recoil of the rifle 10 is taken up by the weighted bag member 48 through the straps 40 and 42 without adversely affecting the firing operation.

Although I have described my invention hereinabove in considerable detail, I do not wish to be limited narrowly to the exact and specific particulars disclosed, but I may also use such substitutes, modifications or equivalents as are included within the scope and spirit of my invention or pointed out in the appended claims.

I claim:

1. In an apparatus for absorbing recoil of a rifle having a barrel, a barrel end, a butt and a stock, and fired while extending above a horizontal surface with said barrel end of said rifle supported by a rest member, the improvement comprising (a) a weighted bag member resting freely on and not attached to said horizontal surface and having straps in contact with said butt and said stock of said rifle, and (b) said weighted bag member includes (1) a first strap which extends tautly along both sides of said stock of said rifle and around and in contact with said butt of said rifle, and (2) a second strap attached to said first strap and extending over the top of said stock adjacent said butt of said rifle.

2. The apparatus of claim 1 including means to adjust the length of said first strap.

3. The apparatus of claim 2 wherein said weighted bag member includes a weight of about at least 25 pounds.

4. A method of absorbing recoil from a fired rifle having a barrel, a barrel end, a butt and a stock, and extending above a horizontal surface comprising the steps of (a) providing a weighted bag member resting freely on and not attached to said horizontal surface and having a first strap extending tautly along the sides of said stock of said rifle and in contact with said butt of said rifle and a second strap attached to said first strap and extending over the top of said stock of said rifle adjacent said butt, and (b) providing a rest member to support said barrel end of said rifle above said horizontal surface, and (c) providing a weight of at least about 25 pounds in said weighted bag member.

* * * * *